US010465987B2

(12) United States Patent
Langlais et al.

(10) Patent No.: US 10,465,987 B2
(45) Date of Patent: Nov. 5, 2019

(54) DUAL-FUNCTION IMPELLER FOR A ROTARY INJECTOR

(71) Applicant: Rio Tinto Alcan International Limited, Montreal (CA)

(72) Inventors: Joseph Langlais, Saguenay (CA); Peter Donald Waite, Saguenay (CA); Francis Breton, Saguenay (CA); Serge Munger, Saguenay (CA); Martin Beaulieu, Verdun (CA)

(73) Assignee: Rio Tinto Alcan International Limited, Montreal (CA)

( * ) Notice: Subject to any disclaimer, the term of this patent is extended or adjusted under 35 U.S.C. 154(b) by 635 days.

(21) Appl. No.: 15/024,894

(22) PCT Filed: Sep. 26, 2014

(86) PCT No.: PCT/CA2014/050922
§ 371 (c)(1),
(2) Date: Mar. 25, 2016

(87) PCT Pub. No.: WO2015/042712
PCT Pub. Date: Apr. 2, 2015

(65) Prior Publication Data

US 2016/0238319 A1 Aug. 18, 2016

Related U.S. Application Data

(60) Provisional application No. 61/883,728, filed on Sep. 27, 2013.

(51) Int. Cl.
*F27D 3/00* (2006.01)
*F27D 27/00* (2010.01)
(Continued)

(52) U.S. Cl.
CPC ..... *F27D 3/0026* (2013.01); *C22C 1/02* (2013.01); *C22C 1/1026* (2013.01);
(Continued)

(58) Field of Classification Search
CPC ..... F27D 27/00; F27D 27/005
(Continued)

(56) References Cited

U.S. PATENT DOCUMENTS 1,526,851 A * 2/1925 Hall ..... F27B 14/00 266/216
3,411,759 A 11/1968 Rapson
(Continued)

FOREIGN PATENT DOCUMENTS

| | | |
|---|---|---|
| CA | 2133154 A1 | 3/1995 |
| CA | 2251230 A1 | 2/1998 |
| FR | 2604107 A1 | 3/1988 |

OTHER PUBLICATIONS

Dec. 1, 2014—International Search Report of PCT/CA2014/050922.
Feb. 14, 2017—(CN) Office Action—App 201480053315.0—Eng Trans.

*Primary Examiner* — Lois L Zheng
(74) *Attorney, Agent, or Firm* — Banner & Witcoff, Ltd.

(57) ABSTRACT

The dual-function impeller can be rotated in molten metal in a direction of rotation, as part of a rotary injector. The impeller can have a body having an axis, a plurality of blades circumferentially interspaced around an axis, and an aperture coinciding with the axis. The blades having both a radially extending portion facing the direction of rotation and collectively generating a radial flow component upon said rotation, and a slanted portion also facing the direction of rotation, inclined relative to a radial plane, and collec-
(Continued)

tively generating an axial flow component directed away from the rotary injector upon said rotation.

17 Claims, 8 Drawing Sheets

(51) Int. Cl.
*C22C 1/02* (2006.01)
*C22C 1/10* (2006.01)

(52) U.S. Cl.
CPC ..... *F27D 3/0033* (2013.01); *F27D 27/00* (2013.01); *F27D 27/005* (2013.01)

(58) Field of Classification Search
USPC ..... 266/233–235
See application file for complete search history.

(56) References Cited

U.S. PATENT DOCUMENTS

| | | | |
|---|---|---|---|
| 4,283,357 | A | 8/1981 | Sidery |
| 4,456,424 | A | 6/1984 | Araoka |
| 4,548,765 | A | 10/1985 | Hultholm et al. |
| 4,611,790 | A | 9/1986 | Otsuka et al. |
| 4,802,656 | A | 2/1989 | Hudault et al. |
| 5,080,715 | A | 1/1992 | Provencher et al. |
| 5,143,357 | A | 9/1992 | Gilbert et al. |
| 5,160,693 | A | 11/1992 | Eckert et al. |
| 5,527,381 | A | 6/1996 | Waite et al. |
| 6,394,430 | B1 | 5/2002 | Forschner et al. |
| 6,589,313 | B2 | 7/2003 | Bilodeau et al. |
| 6,689,310 | B1 | 2/2004 | Cooper |
| 6,960,239 | B2 | 11/2005 | Bilodeau et al. |
| 2008/0230966 | A1 | 9/2008 | Cooper |

* cited by examiner

DUAL-FUNCTION IMPELLER FOR A ROTARY INJECTOR

CROSS-REFERENCE TO RELATED APPLICATIONS

The present application is a United States National Phase filing of International Application No. PCT/CA2014/050922, filed on Sep. 26, 2014, designating the United States of America and claiming priority of U.S. Provisional Patent Application No. 61/883,728, filed Sep. 27, 2013, by Applicant, and the present application claims priority to and the benefit of both the above-identified applications, the contents of which are hereby incorporated by reference herein.

FIELD

The improvements generally relate to the field of rotary injectors for adding particulate salt fluxes and/or powdered metallic alloying elements to a liquid, as applicable to aluminum melting and holding furnaces for instance.

BACKGROUND

Rotary injectors were used to treat molten aluminum, such as disclosed in U.S. Pat. No. 6,960,239 for instance. In these applications, a rotary injector, known as a rotary flux injector, was used to introduce particulate material into molten aluminum held in a large volume furnace.

An example of a known rotary flux injector is shown in FIG. 1 as having a rotary shaft 15, typically made of a temperature resistant material such as graphite, leading to an impeller 16 mounted to the end thereof. A supply conduit is provided along the shaft and leads to an axial outlet across the impeller 16. A fluxing agent, typically in the form of a mixture of particulate salts, is entrained along the supply conduit by a carrier gas. The impeller 16 has blades or the like to favour the integration of the fluxing agent in the molten metal, in an action referred to as shearing. The geometrical design of the impeller was directly related to shearing efficiency, and radially-oriented blades generating a radial thrust inside the molten metal were used to this end. The depth d at which the impeller 16 is rotated in the molten metal corresponds to the distance between the upper edge of the impeller 16 and the melt surface 13. Traditionally, a minimal depth d was prescribed for the impeller to correctly operate. The minimal depth d was equal to or above the diameter of the impeller, depending on the applications.

It is also common to introduce alloy ingredients into the molten aluminum. Once the alloy ingredients were introduced, a boat propeller like impeller with slanted blades was rotated inside the molten metal for mixing the alloy ingredients evenly in the molten aluminum. Impellers with slanted blades produced an axial thrust inside the molten metal, and axial thrust was associated to mixing efficiency.

All these steps correspond to a significant amount of time required to produce a batch of aluminum in a furnace; and it can thus be understood that although known rotary flux injectors and rotary mixers were satisfactory to a certain degree, the overall process duration limited the overall productivity of aluminum production plants. There was thus a general need to gain further efficiency.

SUMMARY

A dual-function impeller described herein generates a radial thrust in the molten metal which allows shearing a fluxing agent with a satisfactory degree of efficiency, while simultaneously generating an axial thrust which also mixes the molten metal. The dual-function impeller can thus be seen as providing an additional function when compared to either a fluxing impeller or a mixing impeller. Moreover, in some instances, using an impeller design taught herein was found to reduce the overall process time for producing a batch of aluminum alloy when compared to sequentially using a fluxing impeller and then a mixing impeller.

In accordance with one aspect, there is provided a dual-function impeller for rotation in molten metal in a direction of rotation, as part of a rotary injector, the impeller comprising a body having an axis, a plurality of blades circumferentially interspaced around the axis, and an aperture coinciding with the axis, the blades having both a radially extending portion facing the direction of rotation and collectively generating a radial flow component upon said rotation, and a slanted portion also facing the direction of rotation, inclined relative to a radial plane, and collectively generating an axial flow component directed away from the rotary injector upon said rotation.

In accordance with another aspect, there is provided a dual-function impeller for rotation in molten metal in a direction of rotation, as part of a rotary injector, the impeller comprising a body having an axis and a central outlet, a set of radial blade portions circumferentially interspaced from one another around the axis, located adjacent to the outlet, each having a radial blade leading face facing the direction of rotation, the radial blade leading faces collectively generating a radial flow component upon said rotation, a plurality of channels, each channel extending between a corresponding pair of adjacent radial blade portions; a set of radial surfaces circumferentially interspaced from one another around the axis, each one of the radial surfaces forming an axial limit to a corresponding one of the channels; and a set of axial blade portions circumferentially interspaced from one another around the axis, radially-outwardly from the set of radial blade portions, each having a leading face facing the direction of rotation, the axial blade leading faces being inclined relative to a radial plane and collectively generating an axial flow component directed axially away from the rotary injector upon said rotation.

In accordance with another aspect, there is provided a process of treating a molten metal using a rotary injector having an impeller and an axial outlet, the process comprising simultaneously: generating both an axial flow component and a radial flow component in the molten metal by rotating the impeller; injecting at least particulate material or gas through the impeller; and shearing the injected material against rotating portions of the impeller and by the drag generated by the rotating blades.

Many further features and combinations thereof concerning the present improvements will appear to those skilled in the art following a reading of the instant disclosure.

DESCRIPTION OF THE FIGURES

In the figures.

DETAILED DESCRIPTION

Figure 1:
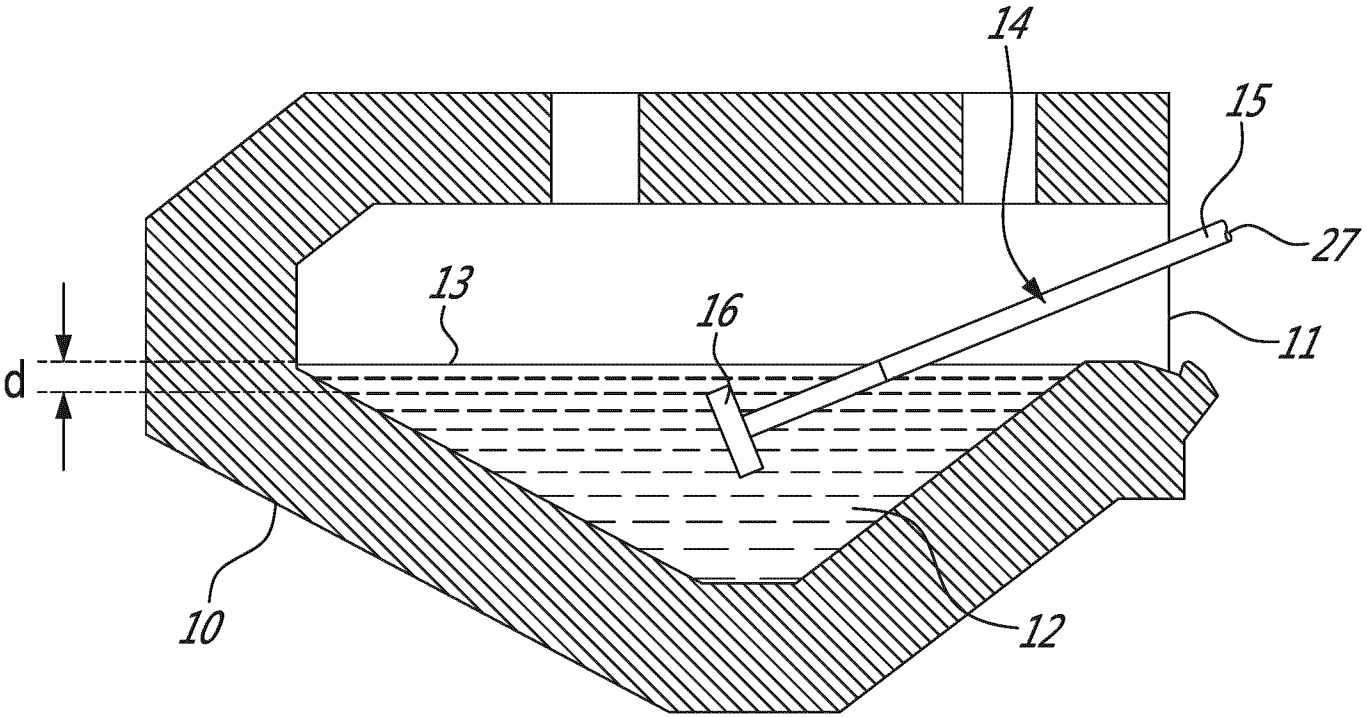
FIG. 1 PRIOR ART
FIG. 1 is a schematic view showing a rotary injector in use in molten aluminum held in a furnace.

Referring to FIG. 1, a large aluminum melting furnace 10 has a side opening 11 and contains a bath of molten aluminum 12 with a melt surface 13. Extending through the opening 11 is a rotary injector 14 having an elongated shaft 15 having a shaft axis, a proximal end 27 and an opposite distal end, and an impeller 16 mounted on the distal end of the shaft 15. A supply conduit (not shown) extends internally along the entire length of the shaft and across the impeller 16, to an axial outlet located on a distal side of the impeller 16. The supply conduit can be said to form an injection path for the particulate fluxing solids, a portion of which extending across the impeller 16, centrally (axially) thereof. During use, particulate fluxing solids are entrained along the supply conduit of the shaft 15 by gasses, into the molten metal bath 12. During use, the shaft 15 and the impeller 16 rotate while the particulate fluxing solids are injected into the molten metal bath 12. Henceforth, the particulate fluxing solids are dispersed in the liquid aluminum both by the speed at which they exit the distal end of the shaft, and by the rotation of the impeller which produces a shearing effect. By the time the particulate fluxing solids reach the axial outlet of the shaft, the solids are typically completely liquefied by the heat and can take the form of liquid droplets mixed with bubbles of gas. The fluxing solids can be used to reduce the levels of alkali metals and non-metallic inclusion particles in large aluminum melting and holding furnaces, for instance.

Figure 2:
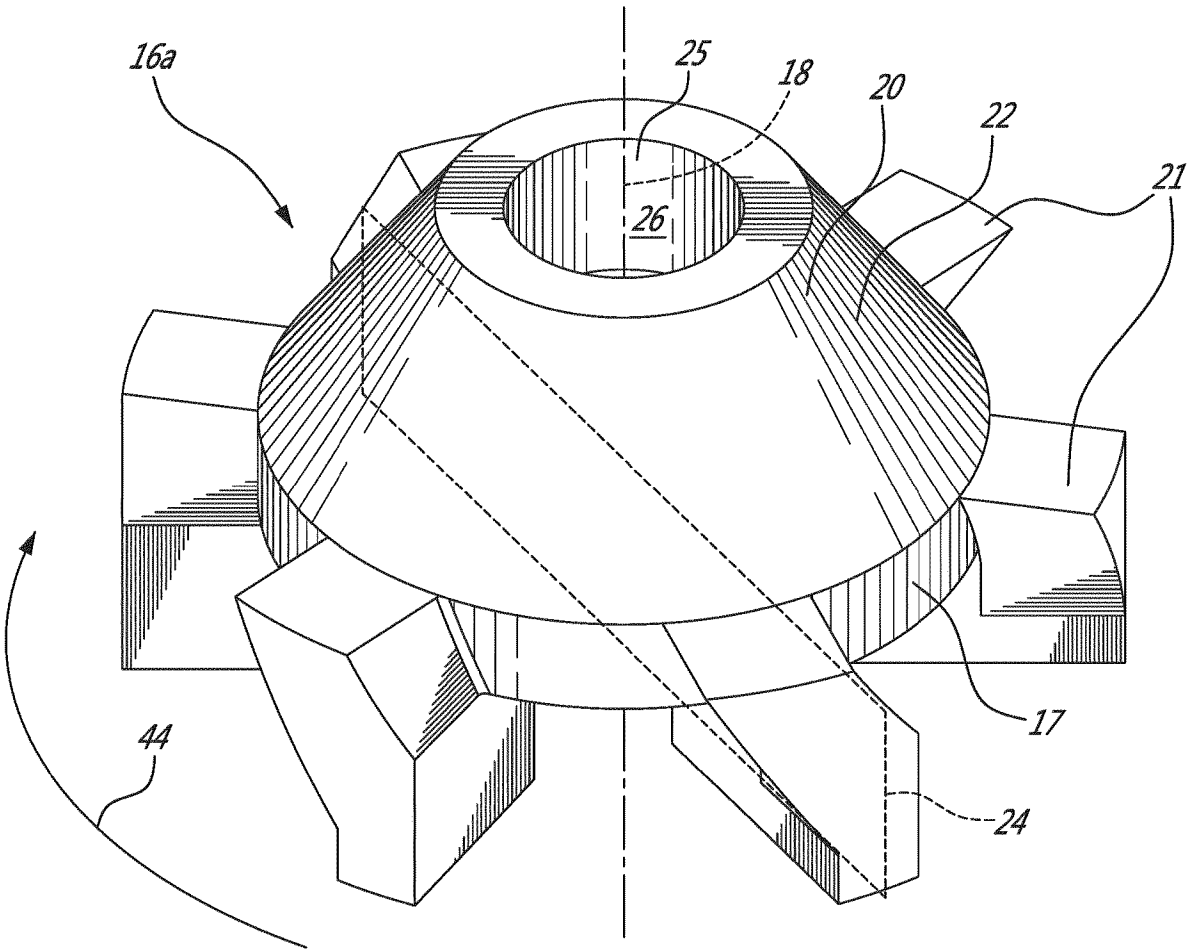
FIG. 2 and FIG. 3 are two different oblique views showing a first example of a dual-function impeller.
Figure 3:
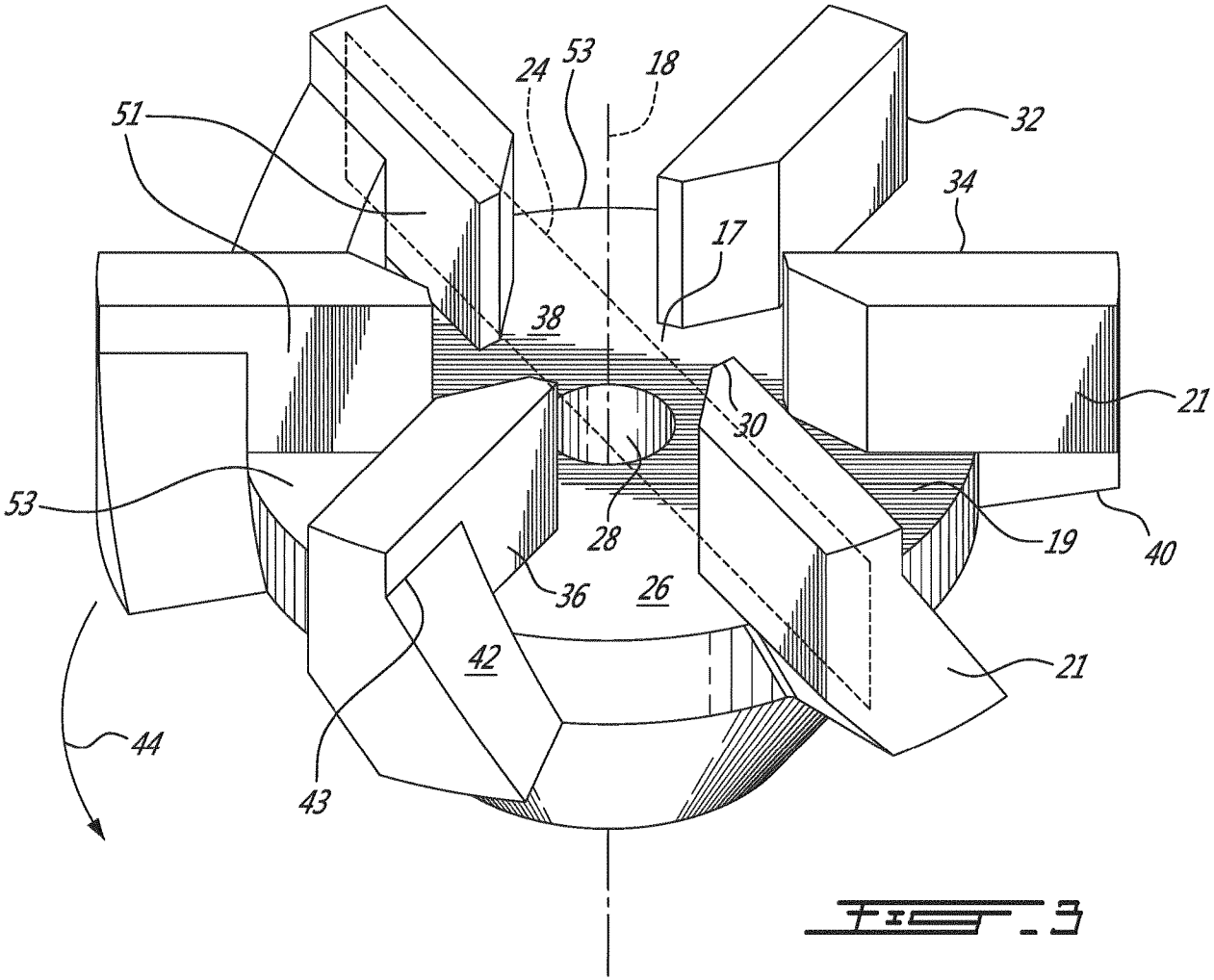

An example of a dual-function impeller 16*a* shown in greater detail in FIGS. 2 and 3. The impeller 16*a* can be seen to generally have an axis 18 (rotation axis) and a plurality of blades 21 extending generally in a radial orientation relative to the axis 18.

In this embodiment, the impeller 16*a* can be selectively mounted or dismounted to the shaft 15, a feature which can be advantageous in the case of components made of graphite, although it will be understood that the impeller can be made integral to the shaft in some embodiments. In the illustrated embodiment, in relation to the aforementioned modularity, the impeller 16*a* has a threaded socket 25 extending partially inside a hub, to securely receive a corresponding male thread at the distal end of the shaft 15 on one side. An aperture 26 coincides with threaded socket 25. In this embodiment, the injection path extends inside the aperture 26, along the shaft. A conduit is provided across the impeller at the bottom of the threaded socket 25 (not shown) and provides a portion of the injection path communicating with the supply conduit of the shaft and leading to a circular outlet edge 28, forming an outlet of the injection path, on the distal side of the impeller (see FIG. 3). In this embodiment, the portion of the conduit leading to the circular outlet edge is conical and has a broadening diameter as it nears the circular outlet edge. It will be understood that the circular outlet edge 28 communicates with the supply conduit of the shaft 15 and terminates the internal injection path. In alternate embodiments with interchangeable impellers, various constructions can be used to join the shaft to the impeller. The shaft can entirely extend across the impeller, and bear the circular outlet edge, for instance.

The impeller 16*a* also has a disc-shaped portion or disc 17. In this embodiment, it is also provided with a conical collar 20, or hub, protruding axially therefrom to assist in mounting to the shaft 15, and leading to the disc-shaped portion 17, which was found to provide satisfactory rigidity to the impeller. The conical collar 20 forms has a proximal side 22 of the impeller 16*a* facing the direction of the shaft 15. The disc 17 bears an opposite distal face 19. With this impeller arrangement, a solids/gas mixture can be fed along the supply conduit in the shaft 15, across the impeller 16*a* in the injection path, and out the outlet edge 28 (FIG. 3) at which point the blades 21 serve to shear the solids/gas mixture into the molten metal. When the solid is a salt flux, it can be molten by the point at which it enters the molten aluminum and is readily sheared into small droplets by the blades 21 to effectively distribute them. Even if a solid flux is used, and does not melt by the point at which it enters the molten aluminum, the shearing effect can break up the carrier gas and flux particles, and distribute them into the molten metal.

As best seen in FIG. 3, the blades 21 can be seen to have both a radially-extending aspect, in the form of a plurality of circumferentially interspaced radial blade portions 34 which extend generally parallel to a radial plane extending along corresponding blades, and an axial, or slanted aspect, in the form of axial blade portions 40 having a slanted face 42 which is slanted or inclined relative to a radial plane. To help in understanding these aspects, an example of a radial plane 24 is shown in the figures, and can be understood to be a plane which intersects the axis 18. It will be understood that the radial blade portions 34 having the radially-extending aspect of the blades 21 generates a radial flow upon rotation in the molten metal, which radial flow is relevant in achieving satisfactory shearing efficiency of fluxing salts, gas bubbles, and the like; whereas axial blade portions 40 bearing the slanted aspect of the blades 21 generates an axial flow upon rotation in the molten metal, which axial flow is relevant to molten metal mixing which, in turn, assists in the alloying process. The resulting flow thus includes both a radial flow component and an axial flow component and thus has a somewhat conical aspect.

At least some geometrical features of the impeller 16*a* are directly related to the resulting fluid dynamics upon rotation in molten metal, and therefore also related to shearing efficiency and mixing efficiency. The specifics of the geometrical features of this embodiment will therefore now be detailed.

Referring back to FIGS. 2 and 3, in this specific example, a plurality blades 21 (six in this specific embodiment) are used in association with the disc 17, with which they are made integral (by moulding therewith in this specific embodiment). The six blades 21 are equally interspaced along the circumference of the disc 17 in this embodiment. The blades 21 can be said to have a radially inner end 30 and a radially outer end 32. In this embodiment, a radial portion 34 of the blades 21, having a radially-extending leading face 36 and the radially inner end 30, protrudes axially from the distal face 19 of the disc 17, and tapers gradually at the radially inner end 30 to a concentric circular spacing 38 associated to a distal annular surface provided between the inner ends 30 of the blades 21 and the circular outlet aperture 28. This radial portion 34 of the blades 21 can be associated to a radial portion of the flow upon rotation of the impeller 16*a* in the molten metal. It will also be noted that the axial portion 40 of the blades 21, having a radially-slanted leading face 42 and the radially-outer end 32, protrudes radially from the disc 17, and bears the slanted leading face 42 which can be associated to the axial portion of the flow. It will be noted that in this embodiment, the radial blade leading face 36 extends continuously with and is integral to the axial blade leading face 42. This can be useful in providing a portion of the axial blade portions 40 which also contributes to the shearing effect, and achieving overall functionality, especially considering the high tangential velocity at that radial distance from the axis. Moreover, the radial blade leading face has a thickness which extends past the distal edge 43 of the axial blade leading face 42. This latter feature, which is optional, was retained here to provide additional radial flow, and it will be noted that in alternate embodiments, the distal edge of the axial blade leading face can reach the distal edge of the blades. In alternate embodiments, the radial portions can be distinct from corresponding axial portions of the blades and separated therefrom by a radial, circumferential and/or axial spacing, and/or alternate embodiments can have a different number of radial portions and axial portions, for instance. It will be understood this specific embodiment is designed for rotation in the clockwise rotation direction 44 when viewed from the shaft, i.e. the slanted faces 42 are in the direction of rotation and push directly against the molten metal. The expression 'leading' is used here to refer to the portion against which the fluid is designed to impinge upon rotation, as in 'leading edge' and 'trailing edge' used in aeronautics.

As seen on FIG. 3, the impeller 16*a* can be said to have a plurality of channels 51 each extending between a corresponding pair of adjacent radial blade portions 34. In other words, the channels can be said to each be delimited in the tangential or circumferential direction by two adjacent radial blade portions, and in the axial direction by the disc 17. The channels are open in the axial direction opposite to the disc 17. During use, the injected material is entrained radially along these channels 51 during which period bubbles or large droplets can be broken down by collisions with the radial blade leading face 36, or by drag produced by the preceding blade 21 (with respect to the direction of rotation) in the shearing effect. The disc 17 contributes to this effect by providing an axial limit to the channels between the radial blade portions 34, preventing the entrained injected material from escaping in its axial direction. The disc 17 can be said to have a set of radial surfaces 53 where each one of the radial surfaces 53 extends between a corresponding pair of radial blade portions 34 and form an axial limit to a corresponding channel 51, in one axial direction.

Figure 4:
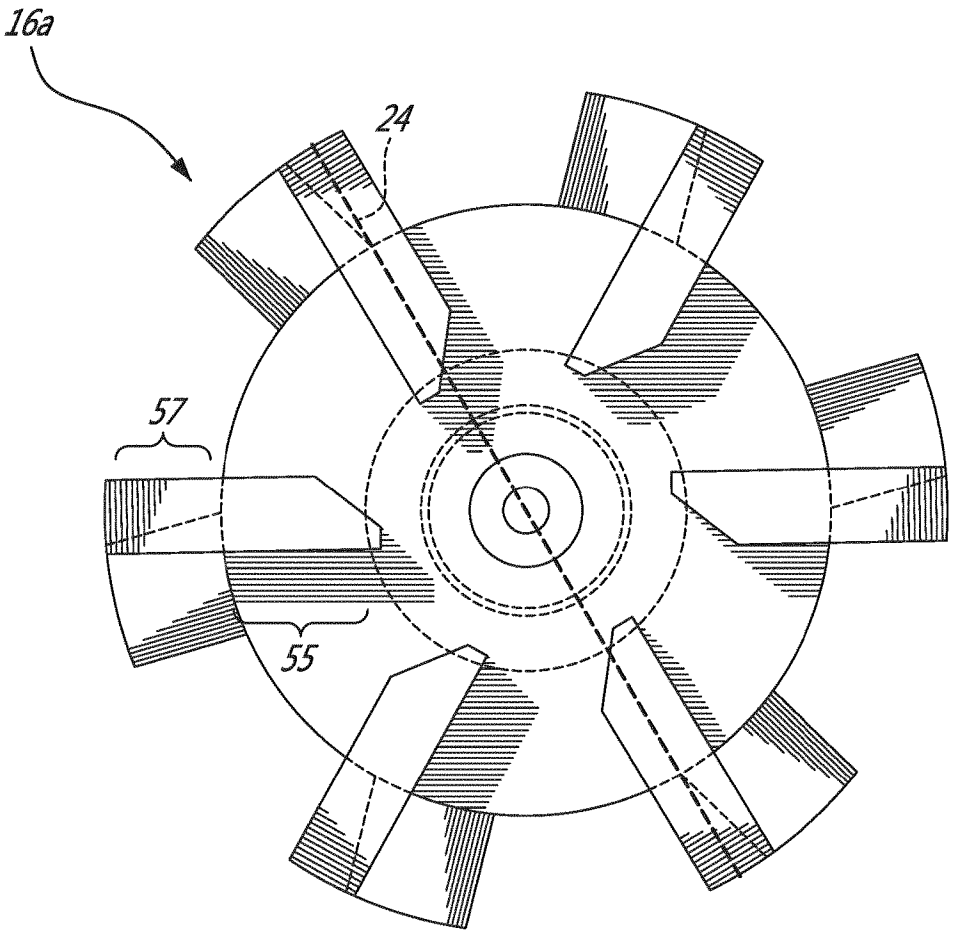
FIG. 4 is a plan view of a distal face of the impeller of FIGS. 2 and 3.

In this specific embodiment, as shown in FIG. 4, the radial length 55 of the radial blade portion 34 is roughly the same as the radial length 57 of the axial blade portion 40, each being of about 50% of the total radial length. In alternate embodiments, the ratio can be within 30% and 70% (with the radial blade portion 34 having 30% of the total length and the axial blade portion having 70% of the total length, or vice-versa, for example), or preferably between 40% and 60%. The angle $\alpha$ of inclination of the axial blade portions relative to a radial plane 24 can be between 30 and 60°, preferably between 40 and 50°, and most preferably about 45° as shown in the illustrated embodiment (see FIG. 5).

Each one of the channels 51 can be said to have a radial inlet which corresponds to a circumferential spacing between the radially inner ends 30 of the corresponding two adjacent radial blade portions 34. The number of blades, the circumferential thickness of the blades and the slanted design of the inner end 30 can be adjusted as a function of a desired circumferential open area ratio of the channel inlets. As best shown in FIG. 4, the open area ratio can be of roughly ¾ in this example, and this ratio can vary in alternate embodiments. When upscaling or downscaling the diameter of the impeller 16*a*, the quantity of blades can be adjusted as a function of maintaining roughly the same open area ratio in order to maintain some fluid dynamics features independently of the diameter.

In this embodiment, the proximal face 22 of the disc is a conical, planar surface which is free from blade portions or other protrusions. This can allow to control the occurrence of vortex in the fluid dynamics, and can also help the impeller 16*a* to resist the undesirable accumulation of debris, which is particularly a potential issue when removing the impeller 16*a* from the molten metal across the molten metal surface.

Moreover, the particular design of this impeller 16*a* can allow using the impeller at a depth d (see ref. in FIG. 1) which is less than the diameter of the impeller, which can be advantageous in some embodiments.

Figure 5:
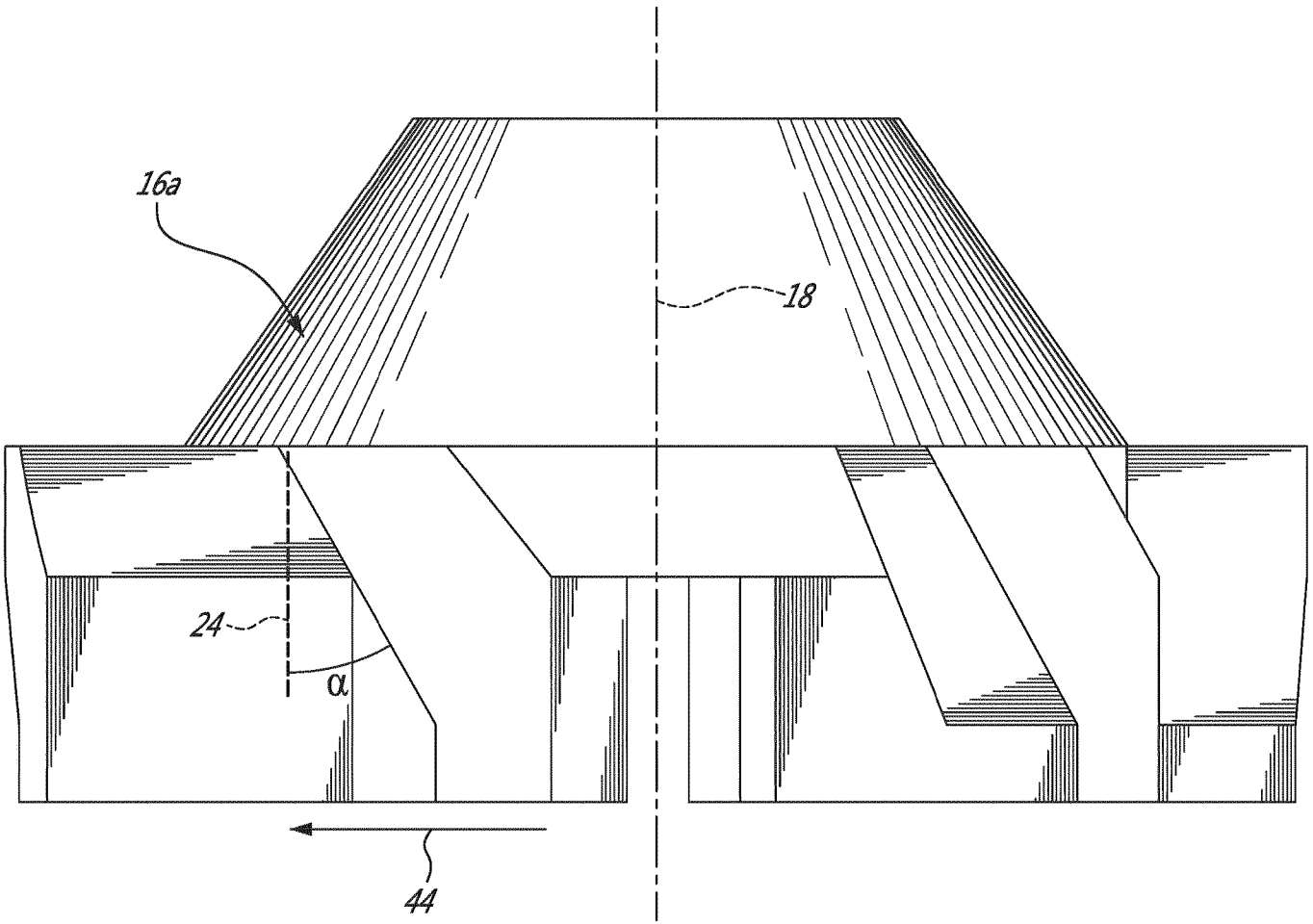
FIG. 5 is a side view of the impeller of FIGS. 2 and 3.

To better understand the shape of the radially-extending portion of the blades, reference can be made to FIG. 4 which shows an example of the radially extending plane 24 extending generally along two of the blades; whereas to better understand the shape of the slanted faces, reference can be made to FIG. 5 which shows the inclination a of the blades with respect to the radially extending plane 24.

A numerical flow simulation was conducted using a geometrical impeller shape which was very similar to the impeller shape shown in FIG. 2, but where the thickness of the blades was slightly shorter and the axial blade portions reached the distal edge of the blades. An example of a resulting flow is shown in FIG. 6, which can be seen to include both a radial flow component and an axial flow component, and which therefore has a roughly conical aspect.

Example 1

Figure 6:
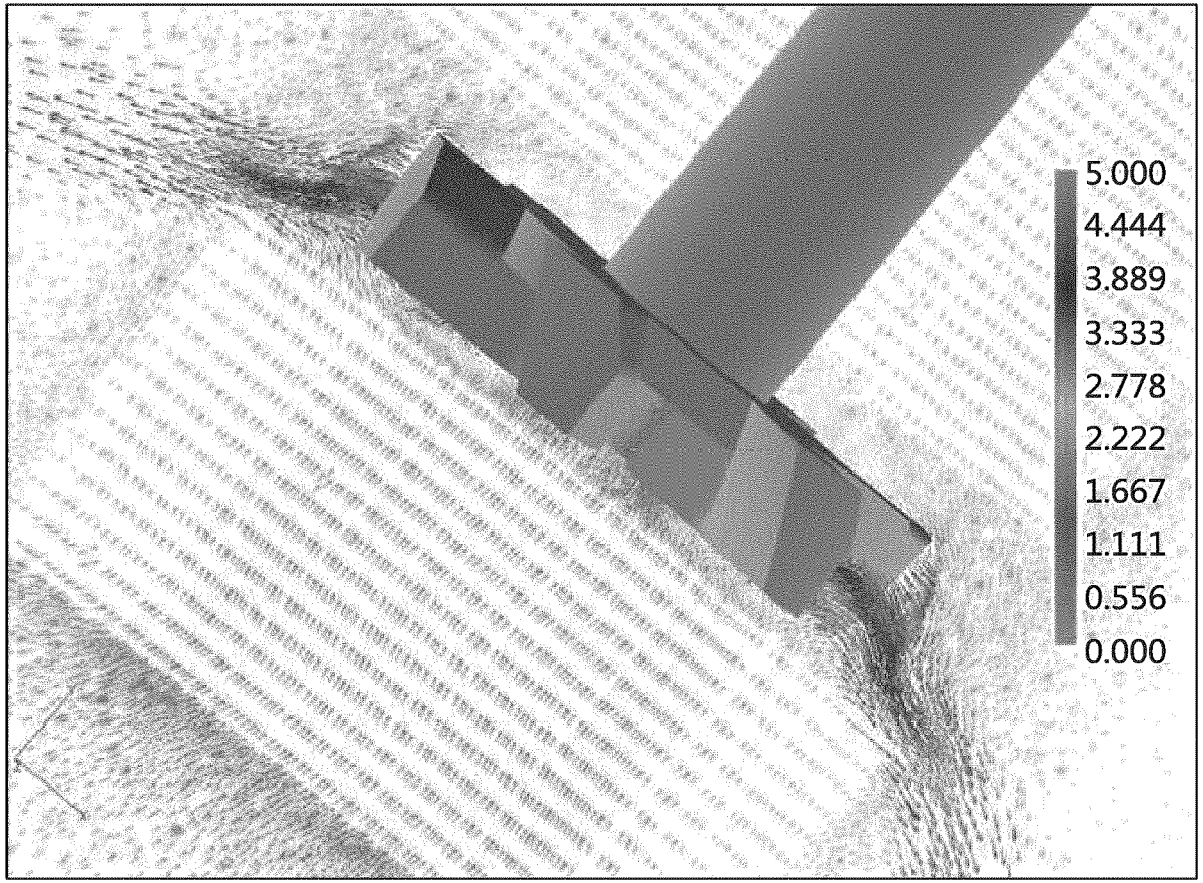
FIG. 6 is a schematic view showing a complex flow resulting from a dual function impeller.

Five tests were made using the dual-function impeller 16*a* having geometrical features as illustrated in FIG. 6, with a rotary flux injector, at a rotation speed of 275 rpm.

In each trial, calcium was added to the aluminum in the form of pre-alloyed ingots. The calcium quantity was selected to achieve an initial concentration of between about 15 and 20 ppm. Then, Promag SI™ salt (60% MgCl, 40% KCl) was injected during 30 minutes with the rotary flux injector, in order to reduce the amount of calcium in the metal. Aluminum samples were regularly extracted, and were used to calculate the kinetic constant k ($min^{-1}$), in order to obtain an indication of shearing efficiency (the greater the constant k, the faster the alkalis will be removed from the metal and thus the higher the shearing effect), according to the following equation:

$$\frac{c}{c_0} = e^{-kt}.$$

In which t is time (minutes), c is the alkali/alkaline earth concentration at time t (the alkaline earth being calcium in this example whereas an alkali such as sodium can be used in an alternate example), and $c_o$ is initial alkali/alkaline earth concentration.

In this example, for the test environment, the diameter of the dual-function impeller 16*a* was of 12", which is higher than the 10" diameter comparison impellers which had a traditional 'high shear' design (an example of which is shown in FIGS. 2 and 3 of U.S. Pat. No. 6,960,239 by applicant). At the same rotational speed, a significantly higher amount of power was required for the dual function impeller, and so as to obtain the same amount of power used, the rotation speed of the dual function impeller was diminished to 275 RPM compared to 300 RPM for the traditional 'high shear' design impeller.

For the same power input, the results demonstrated a higher constant k for the dual function impeller than with the 10" high shear impeller, while additionally presenting axial flow characteristics.

Example 2

Figure 7:
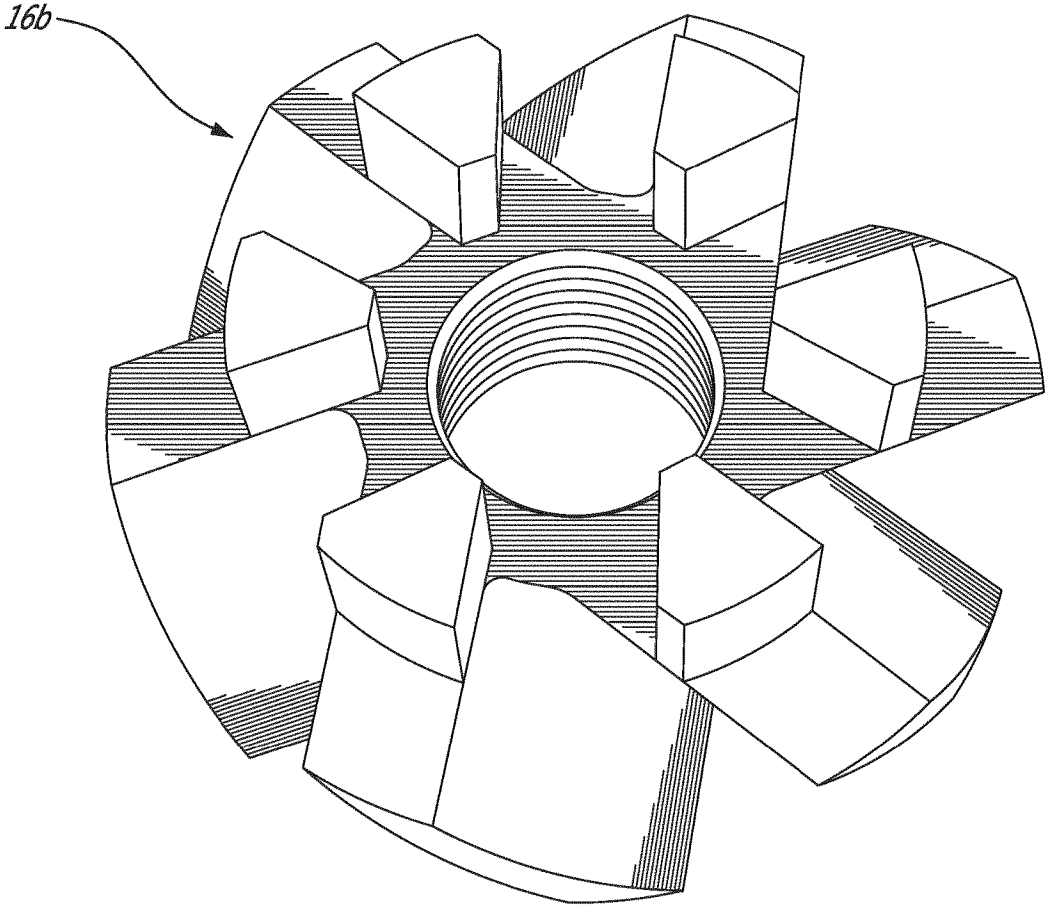
FIG. 7 is an oblique view of a second example of a dual-function impeller.
Figure 8:
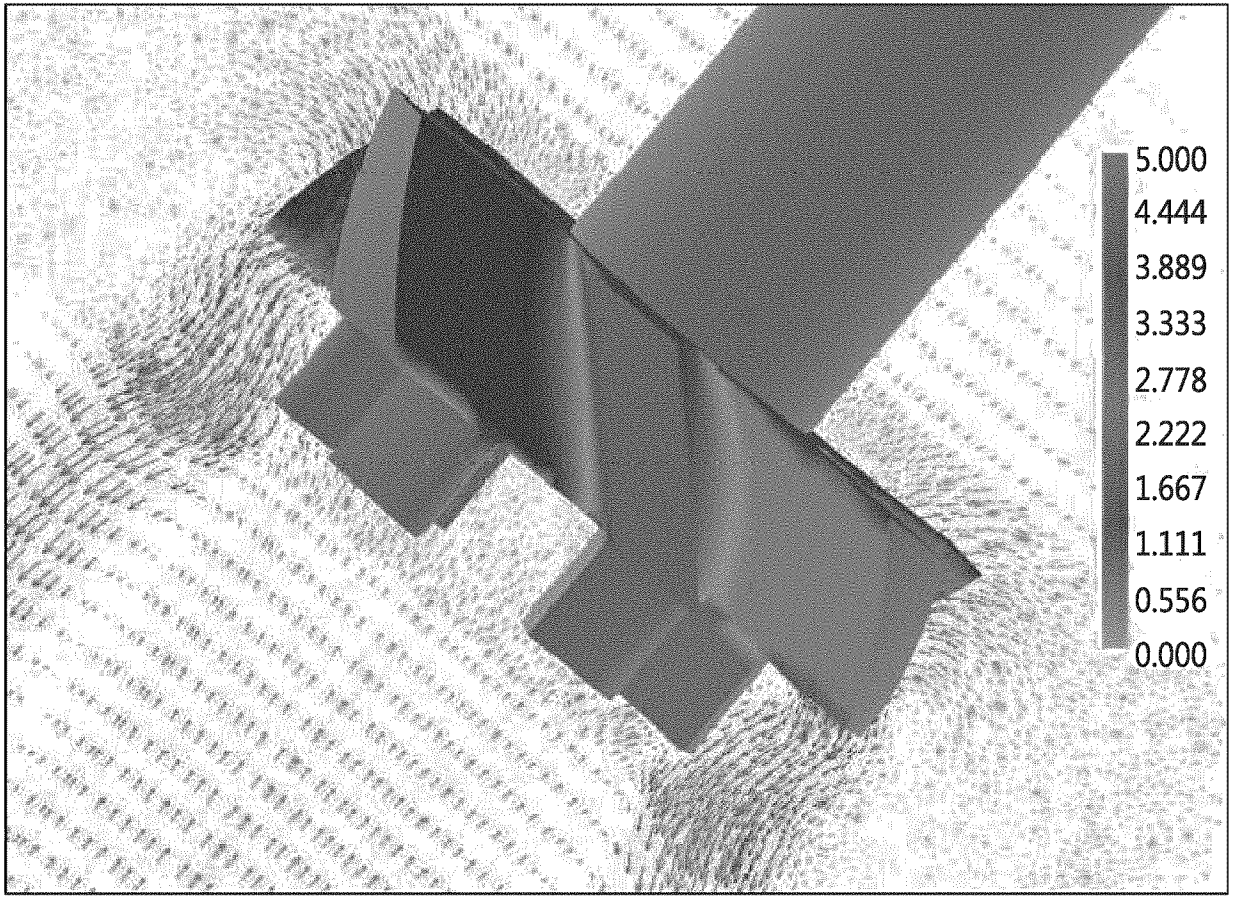
FIG. 8 is a schematic view showing a complex flow resulting from the impeller of FIG. 7.

Five tests were made using a second dual-function impeller 16*b* having geometrical features as shown in FIG. 7, with a rotary flux injector, at a rotation speed of 300 RPM, and in trial conditions otherwise as described above with respect to EXAMPLE 1.

The results demonstrated a constant k which was significantly lower than with the comparison 10" high shear impeller, and undisperssed fluxing salt was observed at the melt surface. Consequently, the geometrical shape tested in EXAMPLE 1 was better adapted to provide both the high levels of the shearing effect required to disperse the fluxing salt and the high axial flow component needed for efficient mixing of the metal.

Example 3

A full scale dual-function impeller 16*a* having geometrical features as described above and illustrated in FIGS. 2 and 3, and having 16" in diameter was used on an industrial furnace over a one-week period. Five tests were fully characterized during this period. The sodium kinetic removal rate (constant k), and the overall mixing of the furnace were characterized and compared to a corresponding traditional high shear impeller having 16" diameter and used in that same furnace. The nitrogen and salt flow rates as well as the rotational speed and power input were the same while using the different impellers.

The results demonstrated a slightly higher constant k when compared to the traditional high shear impeller. Moreover, it generated a much higher metal flow due to the axial flow characteristics of the dual function impeller 16*a*. The improved mixing was validated visually, but also chemically; a quicker alloy ingredient dissolution was observed.

Compared to the traditional high shear impeller, the dual-function impeller 16*a* needed the same amount of energy (motor torque and amperage) to rotate in the molten aluminum bath while procuring similar or improved alkali removal kinetics and improved alloy ingredient dissolution with axial mixing.

It will be noted here that in the examples 1 and 2 above, diameters were scaled-down from a typical industrial scale for testing. Example 3 used an example of an actual 16" impeller diameter which was used in some industrial applications. The examples are provided solely for the purpose of illustrating possible embodiments and their inclusion is not to be interpreted limitatively.

As can be seen therefore, the examples described above and illustrated are intended to be exemplary only. For instance, in alternate embodiments, impellers can have a different number of blades, potentially irregular or otherwise patterned spacings between blades, different blade geometry incorporating both the radial aspect and the axial aspect, such as a curvilinear design rather than straight edge design, different diameters, used at different rotation speeds, etc. Other conduit outlet configurations than an axially distal axial outlet can be used in alternate embodiments. The scope is indicated by the appended claims.

What is claimed is:

1. A dual-function impeller for rotation in molten metal in a direction of rotation, as part of a rotary injector, the impeller comprising:

a body having an axis and a central injection path along the axis, a set of radial blade portions circumferentially interspaced from one another around the axis, located adjacent to the injection path, each having a radial blade leading face facing the direction of rotation, the radial blade leading faces collectively configured for generating a radial flow component upon said rotation, a plurality of channels, each channel extending between a corresponding pair of adjacent radial blade portions;

a set of radial surfaces circumferentially interspaced from one another around the axis, each one of the radial surfaces forming an axial limit to a corresponding one of the channels; and a set of axial blade portions circumferentially interspaced from one another around the axis, radially-outwardly from the set of radial blade portions, each having a leading face facing the direction of rotation, the axial blade leading faces being inclined relative to a radial plane and collectively configured for generating an axial flow component directed axially away from the rotary injector upon said rotation, the axial blade leading faces extending continuously from corresponding ones of the radial blade leading faces.

2. The dual function impeller of claim 1 wherein each of the radial blade portions is adjacent a corresponding one of the axial blade portions and is configured for leading the molten metal directly to the corresponding axial blade portion upon said rotation.

3. The dual function impeller of claim 1 wherein the radial blade portions have a radial length which corresponds to between 30 and 70% of a combined radial length of the radial blade portion and axial blade portion.

4. The dual function impeller of claim 1 wherein an angle of inclination of the axial blade leading faces relative to the corresponding radial planes is between 30 and 60°.

5. The dual function impeller of claim 1 wherein the set of radial surfaces forms part of a disc-shaped portion.

6. The dual function impeller of claim 5 wherein the disc-shaped portion has a proximal surface located opposite the radial blade portions and facing a shaft of the rotary injector, the proximal surface being free of blade portions and surrounding a connector hub of the body.

7. The dual function impeller of claim 5 wherein the disc-shaped portion has a distal annular surface extending radially between the central injection path and a radially-inner end of the radial blade portions, the distal annular surface bearing the set of radial surfaces.

8. The dual function impeller of claim 5 wherein at least a portion of the axial blade portions protrudes radially from the disc-shaped portion.

9. The dual function impeller of claim 8 wherein the at least a portion of the axial blade portions which protrudes radially from the disc-shaped portion protrude therefrom in a direction opposite from a shaft of the rotary injector which leads to the impeller and coinciding with an outlet direction of the central injection path.

10. A dual-function impeller for rotation in molten metal in a direction of rotation, as part of a rotary injector, the impeller comprising:

a body having an axis and a central injection path along the axis, a set of radial blade portions circumferentially interspaced from one another around the axis, located adjacent to the injection path, each having a radial blade leading face facing the direction of rotation, the radial blade leading faces collectively configured for generating a radial flow component upon said rotation, a plurality of channels, each channel extending between a corresponding pair of adjacent radial blade portions;

a set of radial surfaces circumferentially interspaced from one another around the axis, each one of the radial surfaces forming an axial limit to a corresponding one of the channels; and a set of axial blade portions circumferentially interspaced from one another around the axis, radially-outwardly from the set of radial blade portions, each having a leading face facing the direction of rotation, the axial blade leading faces being inclined relative to a radial plane and collectively configured for generating an axial flow component directed axially away from the rotary injector upon said rotation;

wherein the set of radial surfaces forms part of a disc-shaped portion; and wherein the disc-shaped portion has a proximal surface located opposite the radial blade portions and facing a shaft of the rotary injector, the proximal surface being free of blade portions and surrounding a connector hub of the body.

11. The dual function impeller of claim 10 wherein each of the radial blade portions is adjacent a corresponding one of the axial blade portions and is configured for leading the molten metal directly to the corresponding axial blade portion upon said rotation.

12. The dual function impeller of claim 10 wherein the radial blade portions have a radial length which corresponds to between 30 and 70% of a combined radial length of the radial blade portion and axial blade portion.

13. The dual function impeller of claim 10 wherein an angle of inclination of the axial blade leading faces relative to the corresponding radial planes is between 30 and 60°.

14. A dual-function impeller for rotation in molten metal in a direction of rotation, as part of a rotary injector, the impeller comprising:

a body having an axis and a central injection path along the axis, a set of radial blade portions circumferentially interspaced from one another around the axis, located adjacent to the injection path, each having a radial blade leading face facing the direction of rotation, the radial blade leading faces collectively configured for generating a radial flow component upon said rotation, a plurality of channels, each channel extending between a corresponding pair of adjacent radial blade portions;

a set of radial surfaces circumferentially interspaced from one another around the axis, each one of the radial surfaces forming an axial limit to a corresponding one of the channels; and a set of axial blade portions circumferentially interspaced from one another around the axis, radially-outwardly from the set of radial blade portions, each having a leading face facing the direction of rotation, the axial blade leading faces being inclined relative to a radial plane and collectively configured for generating an axial flow component directed axially away from the rotary injector upon said rotation;

wherein the set of radial surfaces forms part of a disc-shaped portion; and wherein at least a portion of the axial blade portions protrudes radially from the disc-shaped portion.

15. The dual function impeller of claim 14 wherein each of the radial blade portions is adjacent a corresponding one of the axial blade portions and is configured for leading the molten metal directly to the corresponding axial blade portion upon said rotation.

16. The dual function impeller of claim 14 wherein the radial blade portions have a radial length which corresponds to between 30 and 70% of a combined radial length of the radial blade portion and axial blade portion.

17. The dual function impeller of claim 14 wherein an angle of inclination of the axial blade leading faces relative to the corresponding radial planes is between 30 and 60°.

* * * * *